US005769290A

United States Patent [19]

Pestana

[11] Patent Number: 5,769,290

[45] Date of Patent: Jun. 23, 1998

[54] HOOK AND LOOP FABRIC WRIST BAND

[76] Inventor: Alan D. Pestana, P.O. Box 6123, Bellingham, Wash. 98227

[21] Appl. No.: 726,128

[22] Filed: Oct. 4, 1996

Related U.S. Application Data

[60] Provisional application No. 60/004,949, Oct. 4, 1995.

[51] Int. Cl.[6] ..... A44B 18/00

[52] U.S. Cl. ..... 224/178; 24/306; 224/165; 224/901.4

[58] Field of Search ..... 224/901.4, 901.2, 224/165, 171, 178, 219, 222; 2/338, 920; 24/31 V, 442, 306, 265 BL, 265 WS

[56] References Cited

U.S. PATENT DOCUMENTS

| | | | |
|---|---|---|---|
| 4,103,808 | 8/1978 | Hallman et al. | 224/901.4 |
| 5,136,759 | 8/1992 | Armour, II | 24/442 |
| 5,289,619 | 3/1994 | Pileggi | 24/306 |
| 5,332,135 | 7/1994 | Fletcher | 224/171 X |

*Primary Examiner*—Renee S. Luebke
*Attorney, Agent, or Firm*—Todd N. Hathaway

[57] ABSTRACT

A wrist band assembly constructed of hook-and-loop fabric material. A first strap member has loop surfaces of the hook-and-loop fabric on its upper and lower sides, and the second strap member has first and second leg portions which define a gap for receiving the first strap member. The two legs of the second strap member have hook surfaces of the hook-and-loop fabric material thereon, for engaging the upper and lower sides of the first strap member when the latter is sandwiched between the two legs of the second strap member. The first strap member is preferably formed by folding a strip of the loop layer of the fabric back upon itself and bonding the two sides together while the second strap member is preferably formed by folding a strip of the hook layer of material so that the hook surfaces face one another. Sleeve portions at the folds provide connection points for attaching the wristwatch or other article.

12 Claims, 6 Drawing Sheets

HOOK AND LOOP FABRIC WRIST BAND

CROSS REFERENCES TO RELATED APPLICATIONS

The present application claims priority of U.S. provisional application Ser. No. 60/004,949 which was filed on Oct. 4, 1995.

BACKGROUND OF THE INVENTION

1. Field of the Invention

The present invention relates generally to wrist bands, and, more particularly, to a hook and loop fabric wrist band for use with, for example, watches such as sports and diving watches, compasses, and like articles.

2. Description of the Related Art

The elastomeric (e.g., synthetic rubber or plastic) wrist bands which are supplied with most diving and sports watches exhibit several serious deficiencies. Firstly, they are almost invariably uncomfortable, especially when the ambient temperature or activity of the wearer causes sweating which accumulates underneath the band. Secondly, the elastomeric material usually develops cracks and/or breaks after a relatively short period of use. Still further, such bands tend to be both cumbersome to use and expensive to replace.

Fabric replacement watchbands are known, but while these represent an improvement over the plastic/rubber bands in a number of respects, especially in terms of comfort and resistance to cracking, they have tended to exhibit drawbacks of their own. Firstly, prior art fabric watchbands have generally employed stitched construction, which not only adds significantly to the cost of manufacturing the article, but the stitching also tends to deteriorate and come undone with extended use. Also, many of these straps have relied on buckles, Clasps, or "D-rings" or similar structures for securement, which are not only just as cumbersome as the corresponding fittings which are used with the rubber/plastic bands, but again adds to the cost of the band and causes discomfort due the chaffing against the wrist. Some straps have employed hook and loop (e.g., VELCRO™) material, but the limited engagement area available between the two strips of fabric has not provided sufficiently secure attachment, especially for use in diving, military operations, and other vigorous and/or hazardous activities.

SUMMARY OF THE INVENTION

Briefly described, the present invention, which overcomes the deficiencies described above, is a fabric wrist band constructed of hook and loop fabric material (e.g., VELCRO™ material), in which a first member of the band is formed by a double-sided strip of the loop portion of the fabric, so that the loop surface forms the upper and lower faces thereof, and a second member of the band which is formed of the hook portion of the fabric, and is bifurcated into upper and lower legs with the hook surfaces thereon facing inwardly toward one another. When placed on the wrist, the loop member of the band is received between the two legs of the hook member and is sandwiched therein so that the hook surfaces engage both the upper and lower surfaces of the loop member of the band, thereby providing a secure attachment. Also, if the outermost layer of the band becomes dislodged during use, the inner layers will remain in engagement so as to retain the watch on the wearer's wrist.

Broadly, the present invention provides a wrist band assembly constructed of hook-and-loop fabric material, the band assembly comprising a first strap member having a loop surface of the hook-and-loop fabric material on both sides thereof, and a second strap member having first and second leg portions which define a gap for receiving the first strap member, the inwardly facing surfaces of the leg portions having hook surfaces of the hook-and-loop fabric material thereon, so that the first strap member can be selectively attached to the second strap member by positioning the first strap member in the gap between the leg portions and pressing the leg portions together, so that the first strap member is sandwiched between the leg portions with the hook surfaces on the leg members in engagement with the loop surfaces on the upper and lower sides of the first strap member.

Preferably, the loop fabric member of the band is formed by folding a strip of the loop fabric back upon itself so as to form a passage for an attachment pin at the fold area, and adhering the back surfaces of the material together so that the loop surfaces face outwardly therefrom. The hook fabric member, in turn, is preferably formed by folding a strip of the hook portion of the fabric upon itself so that a passage for a second securing pin is formed at the fold area, and so that the hook surfaces face inwardly towards one another to form the receiving area for the loop fabric member. A bushing member may be installed at the pin passages formed in the two band members, about which the fabric material is folded. Also, a retainer sleeve may be mounted around each band member so as to force the fabric against the bushing member so as to retain the latter in the passage area. The retainer sleeves may be formed of heat shrink tubing material.

There may also be a bridge strap member mounted to the connecting points at which the first and second strap members are folded over, for carrying tension loads between the first and second strap members. The bridge strap member may comprise a fabric strap member having a first end mounted to the connecting point on the first strap member and a second end mounted to the connecting point on the second strap member. The assembly may further comprise first and second substantially rigid link members attaching the ends of the bridge strap member to the connection points on the first and second strap members. Sleeve portions may be formed at the ends of the bridge strap member, each sleeve portion being configured to receive a roll pin of wristwatch therein.

The band assembly may also comprise pocket means for carrying a house key, car key, or the like, attached to the strap assembly. The pocket means may comprise a pocket strap member attached to the first link member and having a pocket portion formed therein, and a retaining strap member attached to the second link member for selectively holding the pocket strap member flat against the bridge strap member.

Other objects, features and advantages of the present invention will become apparent from the following description when taken in conjunction with the accompanying drawings.

DETAILED DESCRIPTION

Figure 1:
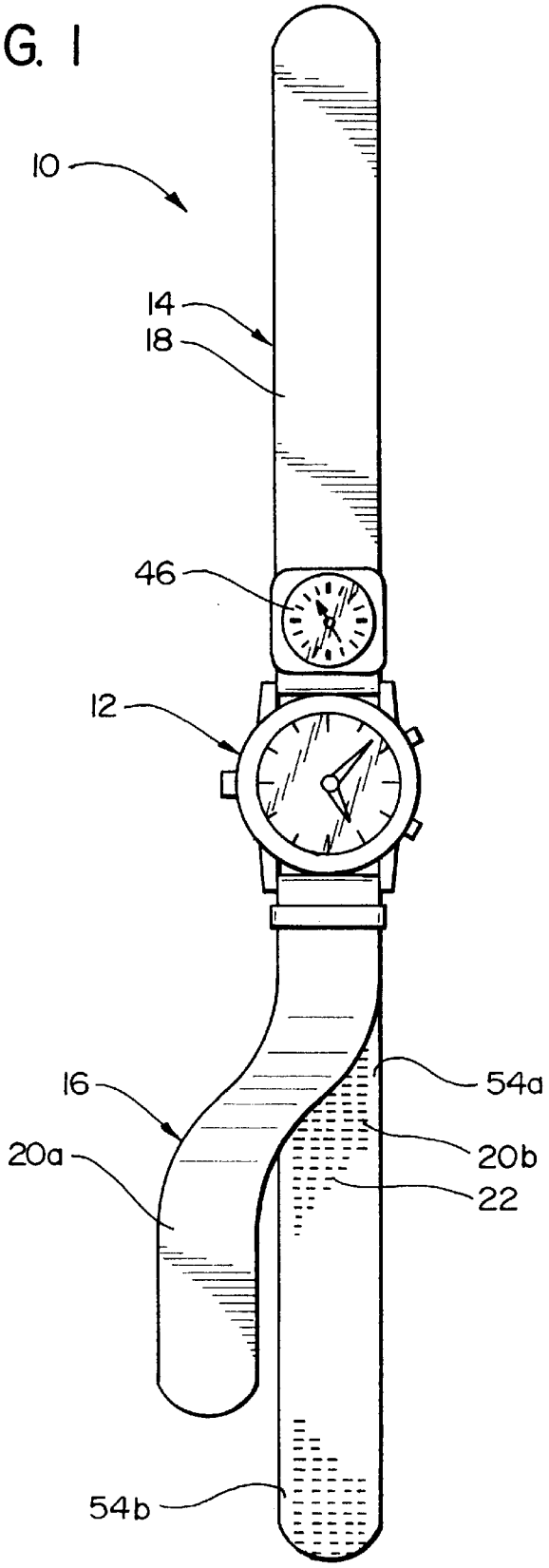
FIG. 1 is a plan view of a wrist band in accordance with the present invention mounted to an exemplary watch for purposes of illustration.

FIG. 1 is a plan view of a wrist strap 10 in accordance with the present invention, mounted to an exemplary diving watch 12. As can be seen, the band comprises first and second strap members 14 and 16. The first strap member 14 is formed of a strip of the "loop" layer 18 of a hook-and-loop (e.g., VELCRO™) material, arranged with the "loop" surfaces exposed on the inner and outer sides thereof. The opposite strap portion 16, in turn, comprises a strip of the exposed "hook" layer of the hook-and-loop (VELCRO™) material, bent back upon itself to form upper and lower strip portions 20*a*, 20*b* with the "hook" surfaces facing inwardly toward one another.

Figure 2:
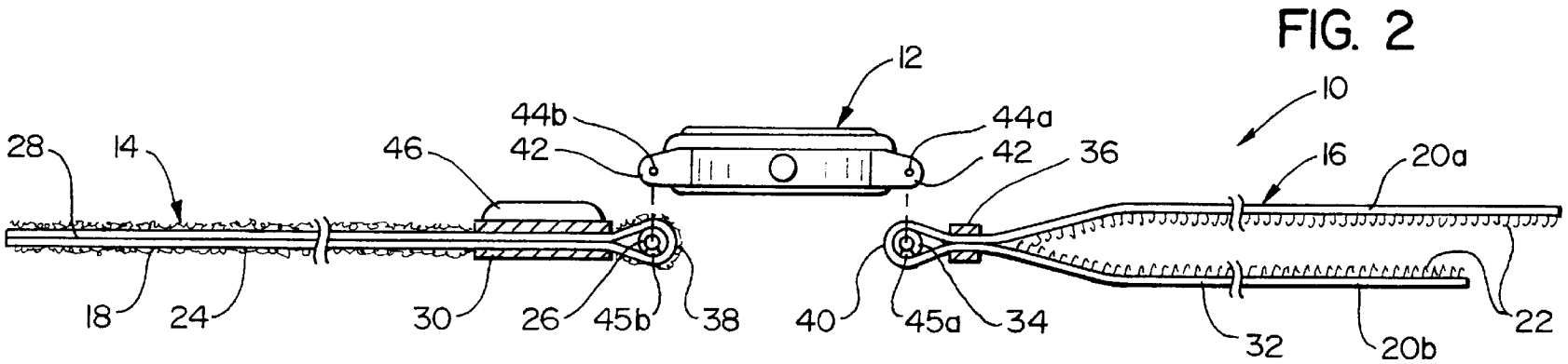
FIG. 2 is a side elevational view, partially in cross-section of the wrist band and watch of FIG. 1, showing the structure of the two portions of the band in greater detail and the manner in which these mount to the conventional roll pins of the exemplary watch.

As can be seen in the cross-sectional view of FIG. 2, each of the two strap members 14, 16 is formed of a single, continuous strip of its layer of the hook and loop material. Accordingly, the first strap member 14 is formed of a single strip of the "loop" layer 24 which is folded back against itself around a plastic bushing 26 at one end and then secured together by a layer of adhesive 28. A retaining sleeve 30, preferably formed of an elastomeric heat shrink material, is slipped over the loose end of the strap and up against the pin bushing 26, where it is secured in place, for example by heat shrinking or application of an adhesive.

Similarly, as was noted above, the other strap member 16 is formed of a continuous strip 32 of the "hook" layer of the VELCRO™ material, folded over a second bushing 34, with the "hook" surfaces 22 facing inwardly. A second retainer sleeve 36 is then slipped over the ends of the two legs 20*a*, 20*b* and mounted against the bushing area in the same manner as described above.

Accordingly, the folded areas of the two retainer sleeves 30, 36 form passage areas 38, 40 at which the fabric is forced tightly against the bushings to hold these in place. The bushings 26, 34 are sized to fit between the mounting lugs 42 of the watch 12, and to receive the roll pins 44*a*, 44*b* therein in a manner similar to a conventional watchband. Also, small (e.g., 1/16 inch) notches 45*a*, 45*b* are provided in the ends of the bushings to permit access to the roll pins for installation/removal of the band.

As can be seen in FIG. 1, the retainer sleeves 30, 36 provide a convenient attachment point for a compass 46, which is useful for diving/military operations, or a similar accessory. Also, the upper surfaces of these sleeves may be used for display of organizational insignia or the like, which in some embodiments may be embossed onto the sleeve during the heat shrink step of assembly, or may be separate medallions which are attached by adhesive or the like.

Figure 3:
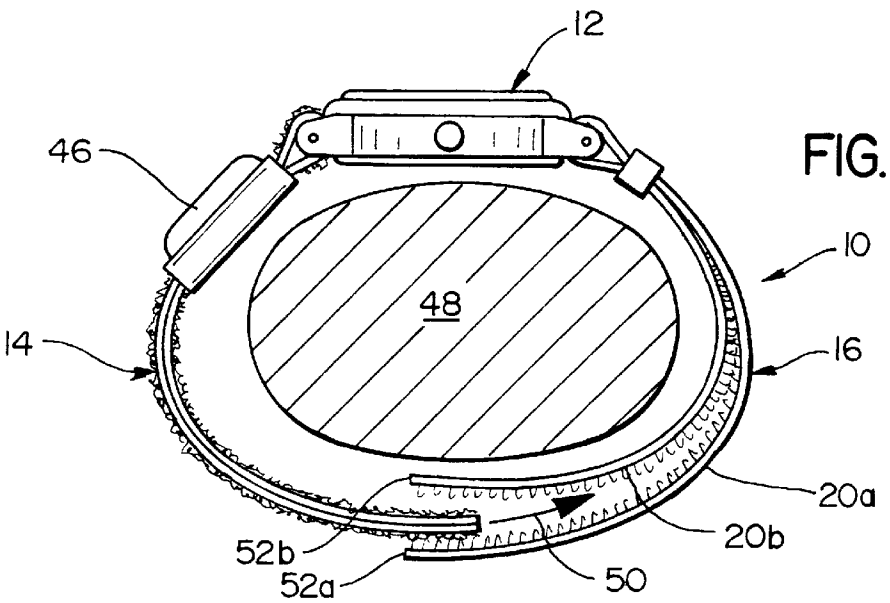
FIG. 3 is a side elevational view of the wrist band and watch of FIGS. 1–2 showing the manner in which this is placed on a person's wrist.

Accordingly, as is shown in FIG. 3, the assembly is very easily secured to the wearer's wrist 48 by placing the split strap member 16 over one side and strap member 14 over the other. The free end of the latter is then inserted in the area between the two legs 20*a*, 20*b* of the opposite strap member, in the direction indicated by arrow 50 in FIG. 3, to cinch the strap tightly about the wearer's wrist. The wearer then runs his fingers over the strap members so that the end of the "loop" strap member 14 is sandwiched between the two legs 20*a*, 20*b* of the hook strap member 16. As this is done, the "hook" surfaces 22 move into engagement with the "loop" surfaces 18. Also, as can be seen in FIG. 2, the outer leg 20*a* of the "hook" strap member is somewhat longer (e.g., approximately ½ inch) than the inner leg 20*b*, so that the ends 52*a*, 52*b* of the two legs end up about even with one another when the band is on the wrist (see FIG. 3), owing to the greater circumferential distance which is covered by the outer leg.

Because the hook and loop engagement is on both the upper and lower surfaces of the two strap portions 14 and 16, there is essentially a doubling of the engagement area as compared with a conventional VELCRO™-type strap, with the result that the present invention provides a far more secure attachment. Also, if for some reason the outer of the two "hook" layers becomes dislodged (for example, by brushing against an obstruction), the other layer will remain in engagement so as to retain the watch on the wearer's wrist. Still further, because the structure requires no stitching or buckles, etc., the problems of earlier fabric bands are avoided, as well as those which are inherent in rubber/plastic watchbands.

Moreover, to enhance the wearer's comfort and to prevent any possibility of damage to a wetsuit, the construction of the band in accordance with the present invention is such as to obviate any possibility of the comparatively abrasive "hook" portion of the hook and loop fabric bearing directly against the skin. Firstly, over the entire length of the strap member 16, the "hook" surfaces are either in engagement with the "loop" strip 14 or bear inwardly against one another (in the area into which the loop member 14 does not extend), all of the "hooks" are covered when the band is on the wrist and there is no possibility of these pressing against the wearer's skin. Also, the hook fabric of which the strap member 16 is formed is provided with clear border (e.g., 3/16 inch) areas 54*a*, 54*b* (see FIG. 1) along its edges to ensure that no hooks will be exposed in the event that there is slight misalignment between the two strap members.

Exemplary dimensions which have been found eminently suitable for a wrist strap constructed in accordance with the present invention, for use with a diving watch are as follows:

Strap Width—13/16 inch

Loop Strap (18) Length—5-¾ inches

Outer Hook Strap (20*a*) Length—5-⅞ inches

Inner Hook Strap (20*b*) Length—5-⅜ inches

It will be understood, however, that the sizes of the band of the present invention may be adjusted from those exemplary dimensions which are given above. For example, for watches which are designed to be fitted with narrower bands (e.g., women's watches), narrower strips of material may be used, and longer or shorter lengths may be employed for varying sizes of wrists. Moreover, although the embodiment which has been shown herein has been described in the context of an exemplary diving watch, it will be understood that the wrist strap of the present invention may be used to secure any other suitable article to a wearer's wrist, such as a compass, calculator, communications device, other types of watches, and so forth.

Figure 4A:
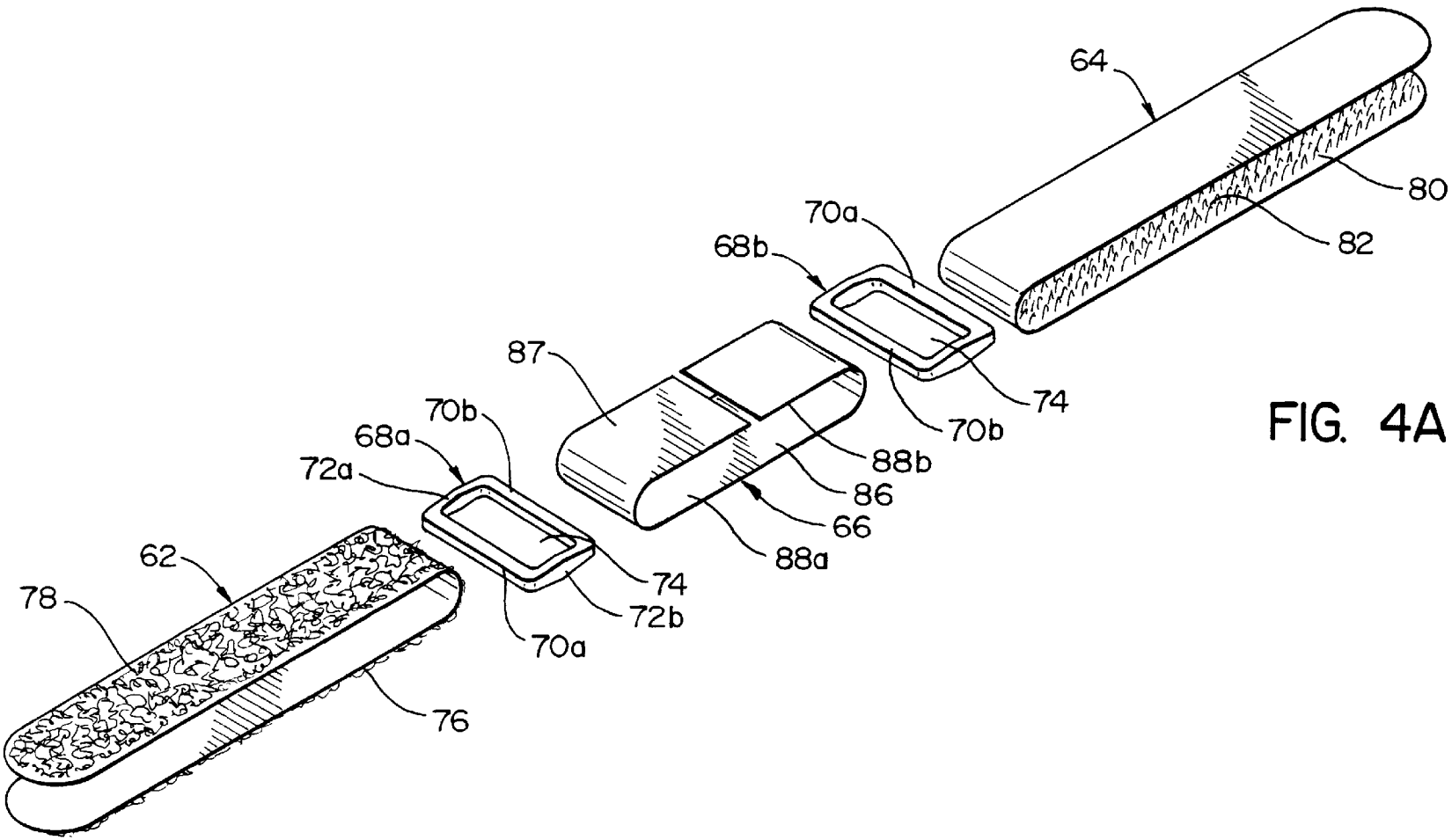
FIGS. 4A and 4B are perspective views of a watch band assembly in accordance with an embodiment of the present invention in which there is a central bridge strap for relieving the tension on the watch roll pins, FIG. 4A being an exploded view which shows the components of the assembly, and FIG. 4B being a view showing the components in their assembled configuration.
Figure 4B:
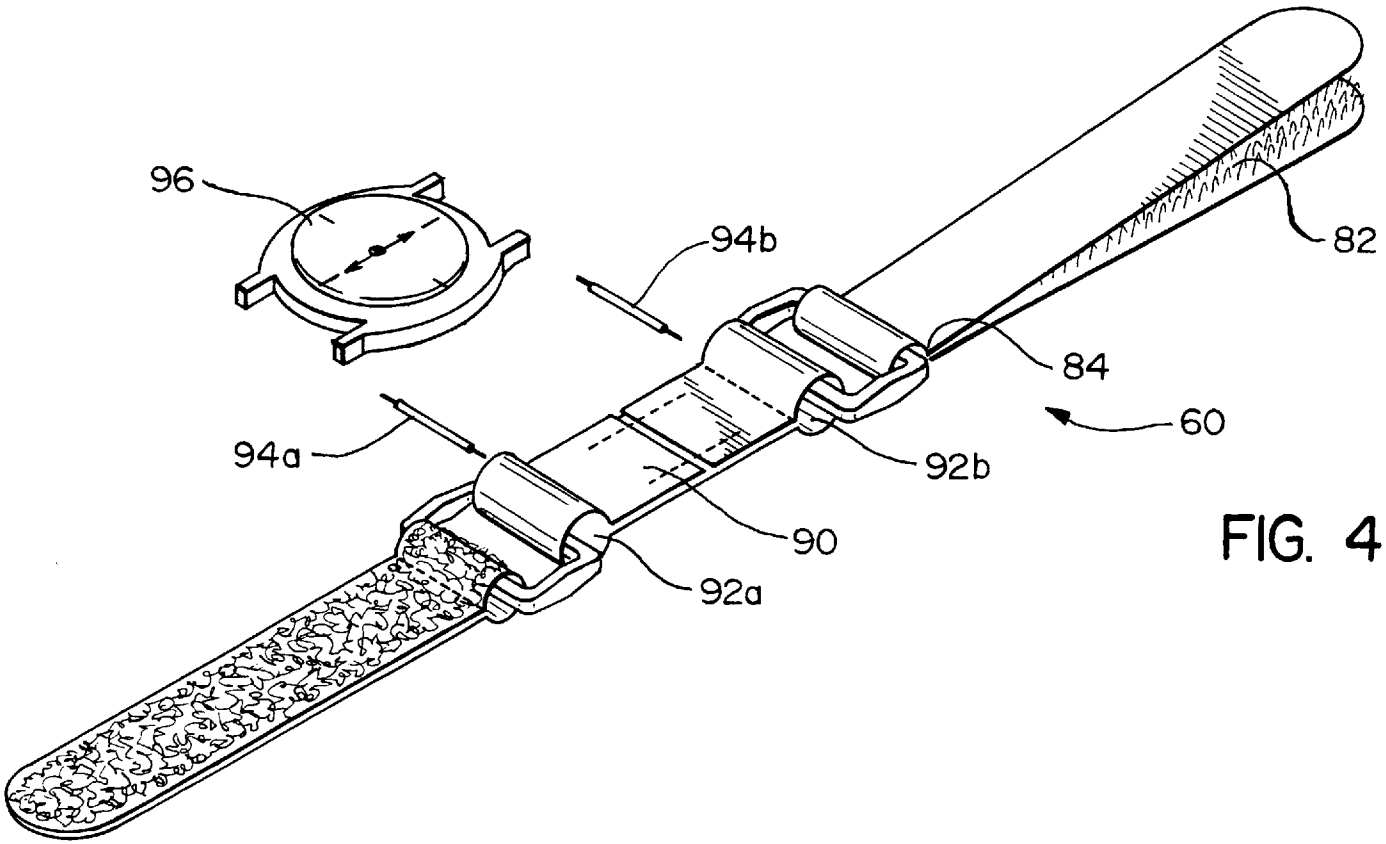

FIGS. 4A–4B illustrate an embodiment of the present invention in which there is a third fabric strap which interconnects the first and second "loop" and "hook" straps, rather than the tension between these two members being borne directly by the roll pins and watch case.

FIG. 4A shows the manner in which a strap assembly 60 is constructed in accordance with this embodiment of the invention. As with the embodiment described above, this includes a "loop" strap member 62 and a bifurcated "hook" strap member 64. These are connected to a central bridge strap member 66 by first and second link members 68*a*, 68*b*. Each buckle member is generally rectangular in form, having first and second transverse spindle portions 70*a*, 70*b* joined by end plate portions 72*a*, 72*b* so as to define a rectangular opening 74. Preferably, each of the link members is a substantially rigid, unitary structure, formed, for example, of injection molded plastic.

To form the loop strap member 62 of the wrist band assembly 60, a strip of the "loop" fabric described above is threaded through the opening 74 of the first link member 68*a*, and bent back upon itself around the first spindle portion 70*a*. The strip is then bonded to itself so that the "loop" surface 78 faces outwardly from the upper and lower sides of the strap member. Similarly, the hook strap member 64 is constructed by threading a strip 80 of the "hook" material (as described above), through the opening 74 in the second link member 68*b*, and bending this back upon itself over the first spindle portion 70*a* thereof so that the "hook" surfaces 82 face inwardly toward one another; the hook strip is then sewn or otherwise joined together adjacent the spindle portion 70*a* in area 84 so as to form the two legs of the strap member 64 with the hook surfaces 82 thereof facing inwardly toward one another as shown in FIG. 4B.

The central bridge strap 66, in turn, is formed of a strip of plain (i.e., without a loop/hook surface) fabric material 86, the ends of which are threaded through the openings 74 in the link members and then bent back and drawn together to form a flat loop structure 87, as shown in FIG. 4A. The central portions of the opposing surfaces 88*a*, 88*b* of the loop structure 87 are then stitched, glued, or otherwise joined together to form the flat fabric bridge section 90 which is configured to extend across the back of the watch, with the two layers of the loop structure 87 near the spindles 70*b* being left free from one another so as to form enlarged, transverse sleeve sections 92*a*, 92*b* at each end of the bridge section. The sleeve sections accommodate the spindles 70*b* of the links, and they also are configured to receive and accommodate the roll pins 94*a*, 94*b*, so that the body of the wristwatch 96 can be attached to the bridge strap of the band assembly 60 as shown in FIG. 4B. As noted above, this relieves the tension on the roll pins, thus obviating the possibility of the pins breaking under such a load and causing loss of the watch and band assembly.

Figure 5A:
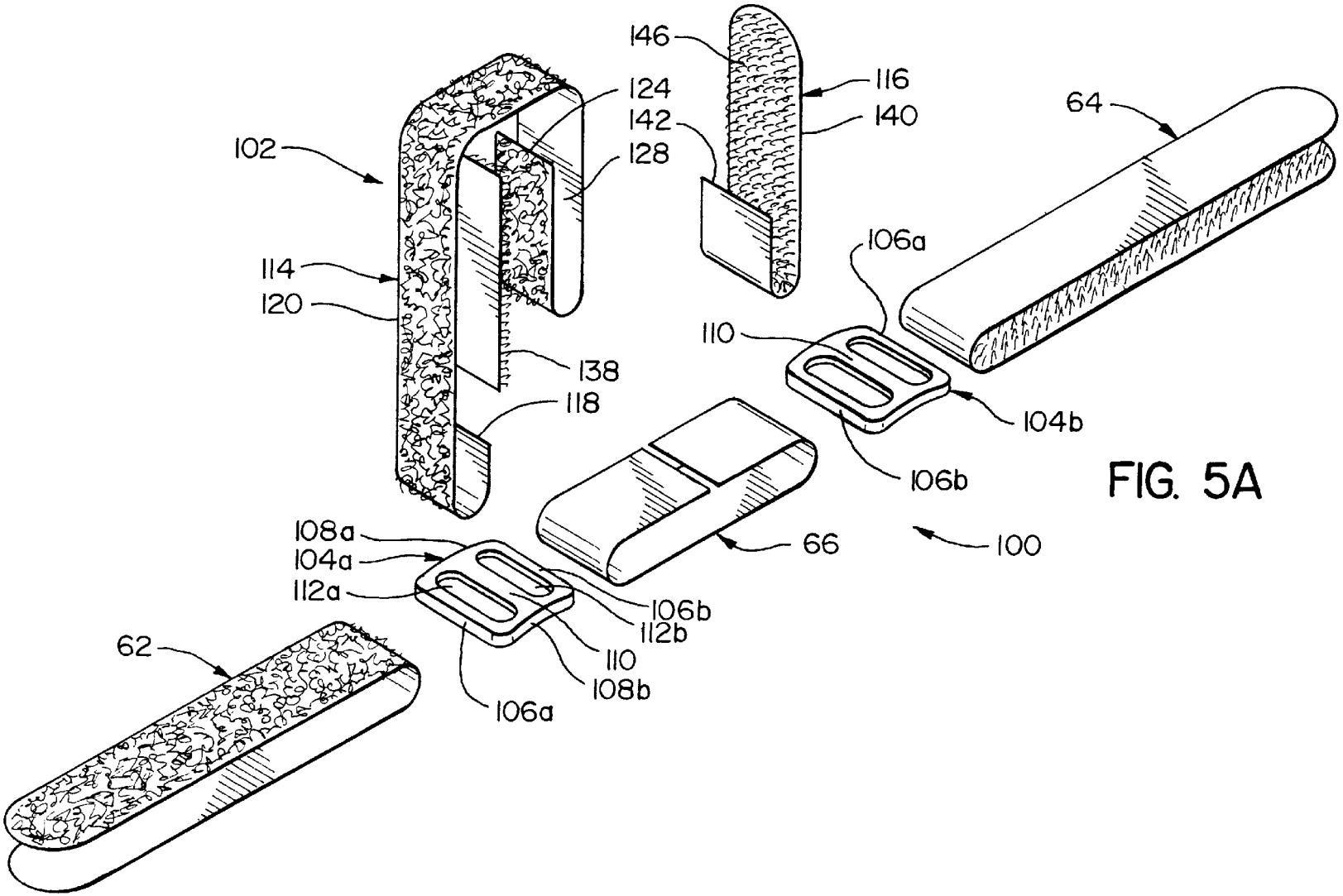
FIGS. 5A and 5B are perspective views, similar to FIGS. 4A–4B, showing a wrist band in accordance with an embodiment of the present invention in which there is a secondary strap assembly for holding a key or the like in a pocket area which is formed thereby, FIG. 5A showing an exploded view of the components of the assembly and FIG. 5B showing the components in their assembled configuration.
Figure 5B:
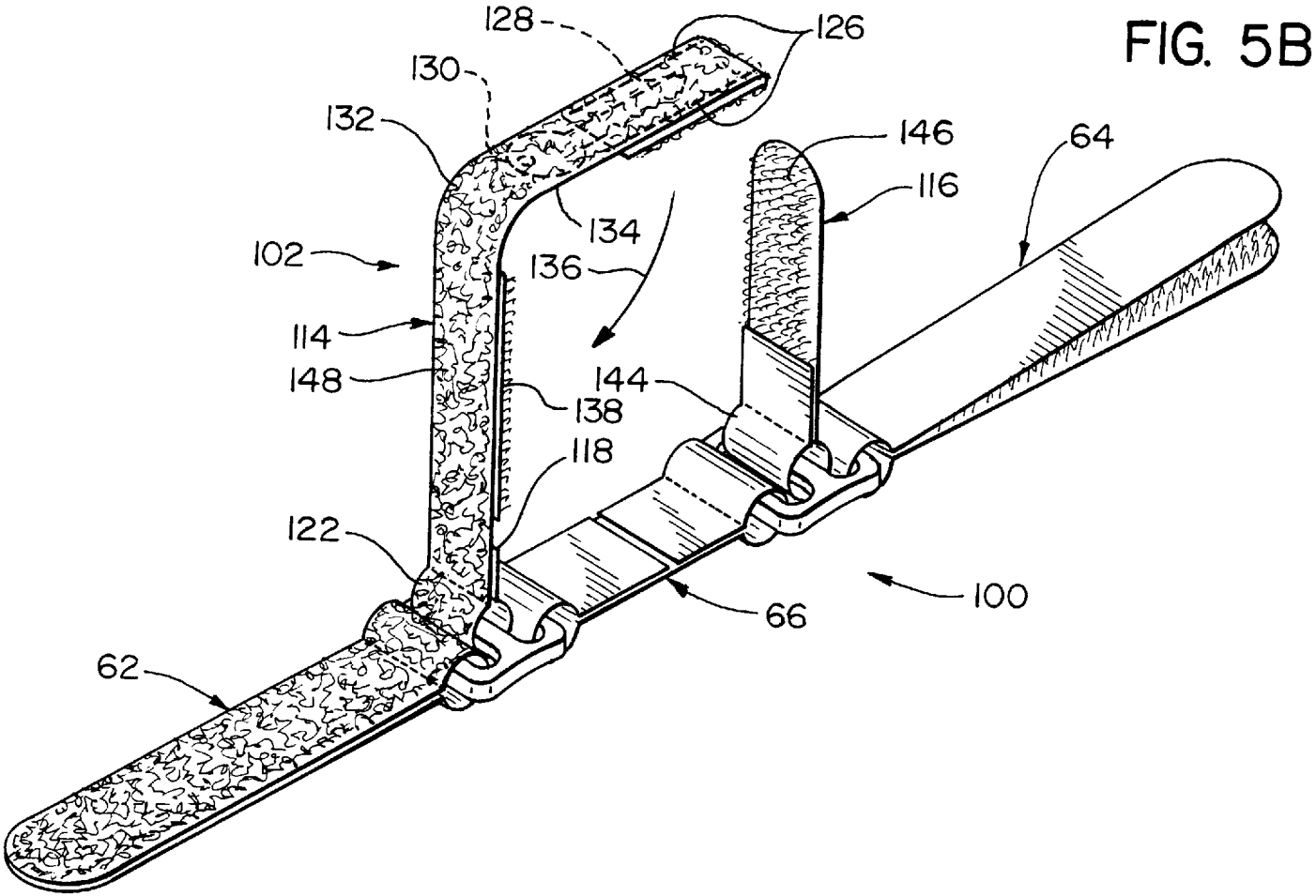

FIGS. 5A–5B shows another embodiment of the present invention, which is a wrist/ankle band 100 similar to that which has been described above with reference to FIGS. 4A–4B, except for the addition of a secondary strap assembly 102 for holding a house, car or locker key or similar item securely to the person's wrist or ankle while running, swimming, or other physical activity. Hence, those components which are shared with the assembly 60 shown in FIGS. 4A–4B will be identified by the same reference numerals as used above.

As can be seen in FIG. 5A, the assembly 100 shown therein includes link members 104*a*, 104*b*, which are essentially similar to the link members 68*a*, 68*b* described above, in that these have spindle portions 106*a*, 106*b* and end plate portions 108*a*, 108*b*; in the embodiment which is illustrated in FIG. 5A, however, the link members include a third, central spindle portion 110 which spans the gap between the two end plate portions, so that the link member has first and second openings 112*a*, 112*b*, instead of the single opening 74 of the link members described above.

The loop strap 62 and hook strap 64 of the assembly are attached to the outer spindles 106*a* of the link members 104, in the same manner as that described above with reference to FIGS. 4A–4B. Similarly, the bridge strap 66 is attached to the inboard spindle portions 106*b* in the same manner as previously described.

The secondary strap assembly 102, in turn, is attached to the central spindle portions 110 of the two link members. The secondary strap assembly includes a first pocket strap member 114 which provides a pocket area to hold a key 130 (see FIG. 5B) or similar article, and a retaining strap member 116. As can be seen in FIG. 5A, the pocket strap at 114 is formed by threading a first end 118 of the strip 120 through the first opening 112*a* in the link member and back up through the second opening 112*b*, and this end is then bonded back to the smooth side of the strip so as to form a sleeve section 122 which encircles spindle portion 110 so as to secure the strap member to the link member.

The second end 124 of strip 120 is bent back upon itself and joined together along its first and second edges by stitching 126 (see FIG. 5B) , or by gluing or other suitable bonding means. This forms a pocket area 128 into which the shank of a key 130 or similar article can be slipped, as shown in FIG. 5B. The end of the strip 120 which is folded over to form the pocket area is preferably selected to be long enough to accommodate the shank of most conventional keys, e.g., in the range from about 1–1.5 inches. Also, the end 124 of the strip (which defines the upper edge of the pocket area) is located a spaced distance from the midpoint 132 of the pocket strap 114, so as to provide an area 134 for accommodating the head of the key and making this accessible for insertion/removal from the pocket area.

For storage, the pocket strap 114 folds at its midpoint 132, in the direction indicated by arrow 136 in FIG. 5B. A strip 138 of the "hook" material is bonded to the smooth inner surface of the pocket strap, below the fold at 132. The loop side of the pocket strap 114, in turn, extends over the outer surface thereof, and then along the inside surface where the end 124 is folded over to form the pocket area. Thus, when the pocket area 128 is folded over and pressed against the hook surface 138, the two layers are secured together, with the fabric at the middle section 132 covering the head of the key and preventing this from slipping out of the pocket area.

The folded over pocket strap can then be laid flat against the upper surface of the bridge strap member 66, with the loop surface facing upwardly therefrom. The retaining strap 116 is then folded over the top of the pocket strap so a to secure the latter in place. As can be seen in FIGS. 5A–5B, the retaining strap member is formed of a strip 140 of the "hook" material, having an end 142 which is threaded through the second link member 104*b* and bonded back to itself to form a sleeve section 144 around the spindle portion 110 of the buckle member, and so that the hook surface 146 thereof faces downwardly when the retaining strap is laid over the top of the bridge strap 66. In this position, the hook surface engages the loop surface of the pocket strap 116 in the area 148, so that the two strap members are held flat against the top of the bridge strap 66 or, if presents, against the top of a watch which is attached to sleeve loops of the bridge strap and prevented from becoming dislodged or flopping about as the person is running, swimming, etc.

As was noted above, the main strap members 62, 64 may be sized to provide a band assembly for the person's wrist or ankle; accordingly, a used in this description and the appended claims, the term "wrist" includes ankles and similar appendages. Also, the secondary strap assembly for retaining a key may be used in conjunction with a wristwatch, in a manner which has been described above with reference to FIGS. 4A–4B. Still further, the wrist band assembly of the present invention may be used for attachment/carrying of various other articles, in addition to the wristwatches and keys described herein.

It will therefore be obvious to those skilled in the art that many variations may be made in the embodiments here chosen for the purpose of illustrating the present invention, without departing from the spirit and scope thereof.

What is claimed is:

1. A wrist band assembly constructed of hook-and-loop fabric material, said band assembly comprising:

a first strap member having a loop surface of said hook-and-loop fabric material on both first and second sides thereof, said first strap member comprising a strip of a loop layer of said hook-and-loop fabric folded over at a connection point and bonded together so that said first strap member extends outwardly from said connection point with said loop surfaces on said first and second sides thereof; and a second strap member having first and second leg portions which define a gap for receiving said first strap member between inwardly facing surfaces of said leg portions, said inwardly facing surfaces of said leg portions both having hook surfaces of said hook-and-loop fabric material thereon, said second strap member comprising a strip of a hook layer of said hook-and-loop fabric material folded over at a connection point so that said first and second leg portions thereof extend outwardly from said connection with said hook surfaces facing towards one another;

so that said first strap member can be selectively attached to said second strap member by positioning said first strap member in said gap between said first and second leg portions and pressing said leg portions together so that said hook surfaces on said leg members engage said loop surfaces on said first and second sides of said first strap member.

2. The wrist band assembly of claim 1, further comprising:

means for attaching a wristwatch to said first and second strap members.

3. The wrist band assembly of claim 2, wherein said means for attaching a wristwatch to said strap members comprises:

a sleeve portion formed at said connection point at which said first strap member is folded over; and a sleeve portion formed at said connection point at which said second strap member is folded over;

said sleeve portions of said first and second strap members being configured to receive first and second roll pins of a wristwatch therein.

4. The wrist band assembly of claim 1, further comprising:

a bridge strap member mounted to said connecting points of said first and second strap members for carrying tension between said first and second strap members.

5. The wrist band assembly of claim 4, wherein said bridge strap member comprises:

a fabric strap member having a first end mounted to said connecting point on said first strap member and a second end mounted to said connecting point on said second strap member.

6. The wrist band assembly of claim 5, further comprising:

first and second substantially rigid link members attaching said ends of said bridge strap member to said connection points on said first and second strap members.

7. The wrist band assembly of claim 6, further comprising:

means for attaching a wristwatch to said bridge strap member.

8. The wrist band assembly of claim 7, wherein said means for attaching a wristwatch to said bridge strap member comprises:

sleeve portions formed at said ends of said bridge strap member, each said sleeve portion being configured to receive a roll pin of a wristwatch therein.

9. The wrist band assembly of claim 6, further comprising:

pocket means for carrying a key, attached to said strap assembly.

10. The wrist band assembly of claim 9, wherein said pocket means comprises:

a pocket strap member attached to said first link member and having a pocket portion formed therein; and a retaining strap member attached to said second link member for selectively holding said pocket strap member flat against said bridge strap member.

11. The wrist band assembly of claim 10, wherein said pocket strap member comprises:

a strip of a loop layer of said hook-and-loop fabric material, said strip having a first end attached to said first link member and a second end which is folded over and joined together to form a pocket area for holding a key, said pocket strap member having said loop surface on at least an upper side thereof.

12. The wrist band assembly of claim 11, wherein said retaining strap member comprises:

a strip of a hook layer of said hook-and-loop fabric material, said strip having a first end which is attached to said second link member and a second end having said hook surface on an underside thereof;

so that said pocket strap member can be laid flat against said bridge strap member and said retaining strap member laid over said pocket strap member so that said hook surface on said underside of said retaining strap member engages said loop surface or said first surface of said pocket strap member.

* * * * *